United States Patent [19]

Boba et al.

[11] 4,255,231

[45] Mar. 10, 1981

[54] CARPET ETCHING

[75] Inventors: Joseph Boba, Fort Lee; Robert P. Conger, Park Ridge; William H. Pedrick, Bound Brook, all of N.J.

[73] Assignee: Congoleum Corporation, Kearny, N.J.

[21] Appl. No.: 48,058

[22] Filed: Jun. 13, 1979

Related U.S. Application Data

[63] Continuation of Ser. No. 612,029, Sep. 10, 1975, abandoned, which is a continuation of Ser. No. 451,350, Mar. 15, 1974, abandoned.

[51] Int. Cl.[3] ..... B29C 17/08

[52] U.S. Cl. ..... 156/645; 28/160; 156/655; 156/668; 252/79.2; 252/79.4

[58] Field of Search ..... 156/654, 668, 655, 645; 8/17, 1155, 166; 28/160; 252/79.1, 79.4, 79.2

[56] References Cited

U.S. PATENT DOCUMENTS

| | | | |
|---|---|---|---|
| 3,849,157 | 11/1974 | Palmer et al. | 28/160 |
| 3,849,158 | 11/1974 | Palmer et al. | 8/17 |
| 3,849,159 | 11/1974 | Palmer et al. | 8/17 |
| 3,856,598 | 12/1974 | Gregorian et al. | 156/277 |
| 3,874,958 | 4/1975 | Scholtis et al. | 156/654 |
| 3,961,882 | 6/1976 | Uits et al. | 8/17 |

*Primary Examiner*—Jerome W. Massie
*Attorney, Agent, or Firm*—Richard T. Laughlin

[57] ABSTRACT

Multi-level nylon pile fabrics having a selectively etched surface and a process of developing an etched effect that comprises selectively applying a chemical fiber etching agent to the surface of a level pile fabric, controlling the depth of penetration into said fabric and heating in the presence of steam to a temperature of 180° F.–250° F. to destroy part of the pile in the treated areas and thus to reduce the height of the pile in the treated areas creating the desired multi-level effect.

19 Claims, 2 Drawing Figures

CARPET ETCHING

BACKGROUND OF THE INVENTION

This application is a continuation of copending application Ser. No. 612,029 filed Sept. 10, 1975 (now abandoned), and entitled "CARPET ETCHING." This latter application is, in turn, a continuation of copending application Ser. No. 451,350 filed Mar. 15, 1974 (and now abandoned).

In the production of nylon pile fabrics, it is often desirable to emboss the surface of the pile in order to provide added decorative appeal. In some instances, the embossed areas are printed with dyes to further embellish the surface design.

Embossing of pile fabrics has been accomplished with a heated embossing roll or plate which has been engraved or otherwise treated to create the design desired in raised relief on the surface of the fabric. A method which eliminates the use of embossing rolls has been disclosed in U.S. Pat. No. 2,875,504. In accordance with this patent the pile fabric is formed from a combination of shrinkable and non-shrinkable yarns. Upon subjecting the fabric either to the influence of heat from a heated surface on which, for example, the fabric is placed face downward, or alternatively, to the emission of infra-red rays, the pile formed from the shrinkable yarns contracts, while the base upon which the yarns are disposed and the non-shrinkable yarns remain intact, thereby yielding a pile made up of high and low areas to give the appearance of an embossed or carved product.

A chemical method of modifying the properties of pile fabrics is disclosed in U.S. Pat. No. 2,020,698. According to this patent, fabric having a pile of an organic ester of a cellulose yarn is locally treated with an alkali or alkaline salt saponifying agent, for example sodium hydroxide, potassium hydroxide or sodium carbonate, that saponifies at least partially the cellulose ester of the selected areas of the fabric described in the patent. The organic esters of cellulose pile yarns that have not been saponified are more difficult to change from their position, after they are set than are the saponified organic esters of cellulose yarns. Therefore it is possible to obtain a differential lay between the saponified and unsaponified organic esters of cellulose pile yarns according to the patent, and a differential lustre or shadowing effect is thus secured. After additional treatment including several process steps, the saponified pile yarn is said to lie flat while the unsaponified yarn remains substantially erect. This method is not represented as affecting the length of the fibers of the pile. Neither does it provide a pile in which the treated fibers will have the same feel or texture as the remaining untreated fibers or the pile.

SUMMARY OF THE INVENTION

It is the primary object of this invention to—provide a simple process for producing a pile fabric having an etched surface.

Another object is to provide such a process which is readily adaptable to standard printing equipment.

Another object is to provide a process which allows the production of pile fabric having etched areas in register with a printed design.

A further object is to provide a selectively etched pile fabric wherein the texture, and other physical and mechanical properties of the low level pile resulting from, and remaining in the fabric after, etching remain unchanged from those of the longer, untreated pile.

Various other objects and advantages of this invention will be apparent from the following description.

It has now been discovered that it is possible to produce multi-level nylon pile fabrics having etched surfaces by contacting selected portions of the level surface with a chemical etching agent for the fibers of the pile fabric with destruction of the ends of the yarn or fibers remote from the fabric base of substrate in which the fibers are looped or otherwise secured.

The etching composition can be transparent so that the appearance of the product is not altered other than in being selectively etched. Alternatively, the etching agent can be applied in a complementary manner with a pigment used to print the fabric so that the color appears in perfect register in the areas of etching agent application.

Exposure of the fabric to steam during the etching process is critical to its success. It is particularly essential that etching occur with steam for a period of time sufficient to effect decomposition of the pile to the desired depth, with ready removal of the destroyed pile by washing and brushing from the fabric.

The depth of the depressed areas of the nylon pile treated in accordance with the invention is controlled by variations in the concentration and type of etching agent and the degree of penetration of the etching agent into the pile fibers.

The completion of the etching process and therefore the ease of fiber removal is determined within certain essential parameters by steaming times and temperatures to which the pile fabric is subjected in order to activate the chemical etching agent which provides the desired effect. The vessel employed for this purpose is designated a "steamer" or steam chamber, and with standard control devices is so equipped as to permit ready maintenance of the foregoing combination of properties. Provision is made for transmission of the fabrics to be treated therethrough at an efficacious rate of speed.

The discovery makes possible the utilization of many types of printing apparatus for purposes of effecting etching, thereby eliminating the need for expensive embossing equipment. Thus it makes possible the production of a product having etched surfaces which can be in complete register with a printed design. Further it allows the etching of a surface without exerting sufficient pressure to permanently deform the pile fabric. A great number of products can be produced by the process. They can be used for floor, walls and ceiling coverings, drapery, upholstery and the like, and, in fact, wherever pile fabrics are utilized. They are readily adaptable to decorating any surface on which pile can be applied. Many additional applications will occur to those skilled in the art.

This invention will be better understood from the following detailed description thereof together with the accompanying self-explanatory drawings in which:

FIG. 1 is an enlarged top view of a section of an embossed product of this invention; and, FIG. 2, is an enlarged cross-sectional view of the same product taken through line 2—2.

DESCRIPTION OF THE PREFERRED EMBODIMENTS

Figure 1:
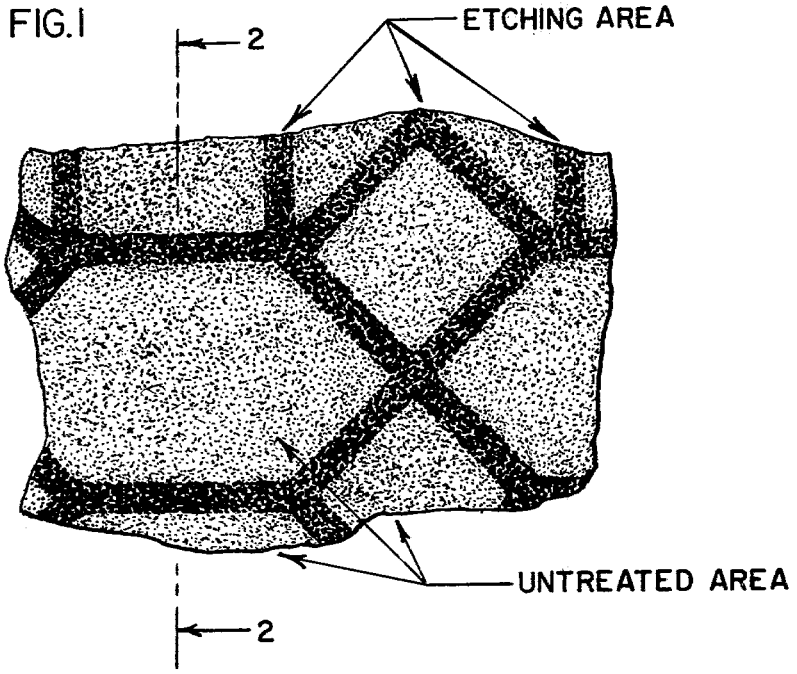
Figure 2:
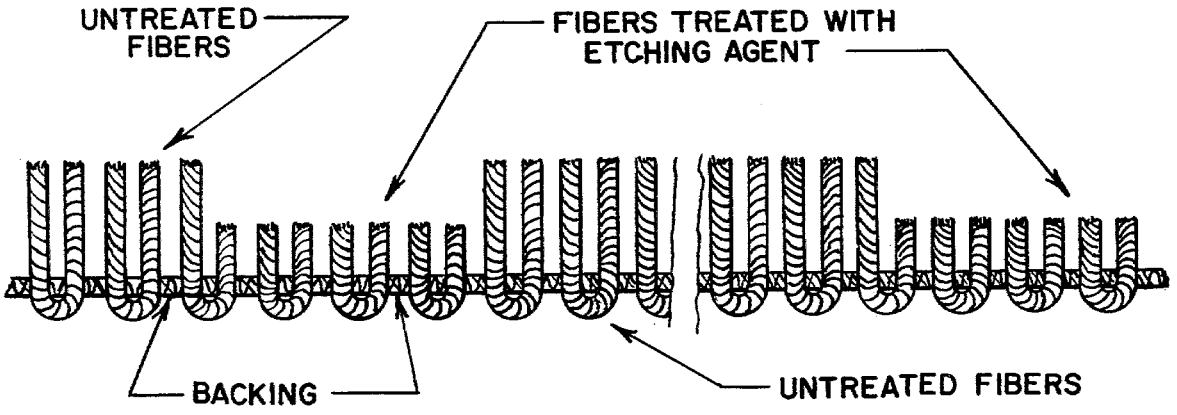

In the production of the pile fabrics of this invention the pile yarn employed commonly is nylon. Synthetic fibers prepared from polyamides or nylon are well known to those skilled in the art and extensive discussion is, therefore, unnecessary. Thus, the term "nylon" or "polyamide" is intended to include any long chain synthetic polymeric amide which has recurring amide groups as a integral part of the main polymer chain and which is capable of being formed into a filament in which the structural elements are oriented in the direction of the axis of that chain.

Polyamide resins coming within this definition and comtemplated in the practise of the present invention are formed generally by reaction of a dicarboxylic acid with a diamine or by the self-condensation of an aminocarboxylic acid. Illustrative of these polyamide resins are nylon 66, prepared by the condensation of hexamethylenediamine and adipic acid; nylon 6-10, prepared from hexamethylenediamine and sebacic acid; both of the foregoing having, as prepared, molecular weights of approximately 20,000 to 50,000 or more; nylon 6 produced by thermal polymerization of epsilon-aminocaproic acid or caprolactam; nylon 11, the self-condensation product of 11-aminoundecanoic acid; as well as a variety of polymers prepared from polymerized, unsaturated fatty acids and polyamino compounds.

The practise of the present invention has, however, particular application to solid polyamides and more particularly to fibers and filaments prepared therefrom which have a denier and tenacity appropriate, and well known to those skilled in the art, for use in carpet, rugs, tapestry and the like. Illustrative of these polyamides are those having a filament denier of 1 to 630 or higher or nylon yarns in the denier range of 20 to 10,000. The tenacities of nylon yarn for use herein are within the range of 4.5 to 8 grams per denier. It is understood additionally that encompassed within the polyamides that can be employed in the practise of this invention are high molecular weight synthetic linear polyamides, in addition to those described hereinabove, that have been modified, for example, to enhance their usefulness for particular applications. Illustrative of the foregoing are the polyamides described in U.S. Pat. Nos. 3,184,436 and 3,560,448 where the dyeability of the polymers is enhanced, for example, by the inclusion of sulfonic acid moieties in the polymer molecule.

An extended discussion of polyamides of sufficiently high molecular weight to be capable of being melt spun into filaments and coming within the contemplation of this invention appears in D. E. Floyd, *Polyamide Resins,* Reinhold Plastics Applications Series (2d Printing 1961), and H. R. Mauersberger, *Matthews' Textile Chemical Properties* (6th ed. 1954).

The etching agents which are applied to the nylon fibers in order to produce the desired etching are also known chemical compounds. For purposes of this invention, the term "etching agent" is defined as any active chemical composition which when applied to the pile fabrics produces a measureable reduction of pile height by destruction of the upper part of the nylon pile. In fact, it is an objective of this invention as indicated heretofore, to effect destruction of a portion of the length of each fiber treated without affecting the texture or other properties of the remainder of the fiber. By "destruction" or its grammatical variations we mean dissolution or disintegration sufficient to enable removal of the destroyed portion of the fiber, as for example, by washing or brushing.

Removal of the destroyed portion of the fiber is a significant aspect of the invention since it is possible to use putative etching procedures which cause deterioration of the fibers of the pile but which result in a plurality of fused tips of pile. It is also possible to cause gelling of the pile surface to effect a continuous film-like surface on the fabric in the treated area. Results, such as these, are clearly undesirable particularly since they do not permit easy removal of the gelled or agglomerated mass from the remainder of the fabric.

The process provided, according to the invention, avoids the foregoing difficulties and results in an etched fabric manifesting no undesirable, incompletely etched residues.

In order to be applicable to the novel process of this invention, the etching agent must, in addition, be capable of application in a manner complementary to standard dyeing or printing techniques using, for example, print screens, and must be capable of substantial removal or inactivation subsequent to the etching action. The etching agent and the process in which it is employed must be susceptible to regulation by factors of time, temperature, viscosity, concentration and the like and result in a fabric having etched areas of uniform and predetermined depth with sharp definition between treated and untreated areas. At the same time parameters must exist which are capable of ready application to commercial scale operation.

The etching agent is applied to the face of the pile fabric remote from the substrate upon which the yarn or fiber forming the pile is mounted in any desired design, whether it be random or pre-determined. One of the easiest methods of applying the agent is by utilizing conventional printing techniques such as silk screen, printing rolls or block printing.

To avoid the difficulties of fusion, gelling and agglomeration, steam is sparged into the heated confined chamber into which the fabric treated according to the practise of the invention is introduced.

The steam is sparged into the foregoing chamber or steamer at a temperature which, subject to other parameters described hereinafter, is maintained, minimally, at 180° F. Generally, the minimum temperature levels are somewhat higher, 212° F. and even 220° F. being most desirable to accomplish the objectives sought herein. Satisfactory maximum temperatures are normally within the range of 225° F. to 250° F. according to the practise of this invention.

Thus the steam is maintained in a superheated state within the steam chamber, that is, the steam is introduced and sustained above its wet point, and maintained beyond its saturation point, so that a drop in temperature will not cause reconversion of the steam to water. A heating coil is mounted within the steamer in one preferred embodiment to maintain the temperature of the sparged superheated or "live" steam therein. The atmosphere of superheated steam within the steamer must be secured before the pile fabric to be etched, with etching paste accordingly applied to its surface, is introduced. If the pile fabric is simply subjected, for example, to a steam jet after the etching agent is applied, the same undesired gelling and agglomeration of the pile surface described above is found to occur. If the steam is not superheated so that a drop in the temperature will cause reconversion to water, condensate is found to occur on the interior wall and ceiling of the steamer and from the latter surface it will tend to fall as water drops on the pile fabric surface to result again in the undesired fusion or gelling of the pile surface in parts of the etched surface. Irregular etching, or indeed, no effective etching at all, may also result from application of water to portions of the pile contemporaneously with the etching process. It will thus be evident that the presence of water on the pile, other than that in the etching composition, as opposed to steam during the etching composition, as opposed to steam during the etching process is disadvantageous.

The etching acid, which is utilized in aqueous solution can be supplied, as part of a transparent vehicle, or as part of a dye composition for use in pile fabric printing.

The time at which the etching agent is applied to the nylon pile fabric prior to its submission to the steamer is not narrowly critical. It is most feasible generally to complete the application immediately prior to introduction of the pile fabric into the steamer. Thus a period of up to twenty minutes between application and steaming is practicable but longer intervals may also be employed.

The etching agent employed is an acid or a plurality of acids, or acid salts, normally not more than two or three in number, having a dissociation constant stronger than acetic acid, and which provides a hydrogen ion concentration in the etching agents or composition of the invention lower than a pH of 1. Illustrative of these acids, and indeed most preferred in accordance with the present invention, are sulfuric acid, hydrochloric acid and phosphoric acid.

Other etching components may also be utilized to supplement the foregoing strong inorganic acids. Illustrative of these are p-toluene sulfonic acid and bisulfate salts such as sodium bisulfate. Certain organic chemicals, especially certain ethers such as cellosolve acetate and dioxane and certain chlorinated hydrocarbons such as methylene dichloride, and ethylene dichloride enhance the etching ability of the strong inorganic acids, thus reducing the required concentration of these acids.

These acids are preferably applied in paste vehicles otherwise identical to those used conventionally in the printing of pile fabrics except that the thickener must be tolerant to low pH and constituting by way of illustration a combination of one or more of the foregoing acids with a thickening agent and water, the latter sufficient *inter alia* to attain a desired pH or acid concentration and paste consistency.

While it is not intended that any particular theory or principle by which the objectives of this invention are achieved be relied on, it is believed in this regard that the etching acid utilized herein may be effective by reason of its ability to effect hydrolysis of the polyamide into its components, for example, into hexamethylenediamine and adipic acid when the pile fibers are made of nylon 66 or into epsilon-aminocaproic acid where nylon 6 is used. Thus the etching acid according to this belief will function as a catalyst and water is a necessary reactant to secure the desired etching effect.

The etching paste utilized according to the invention, should, if it contains a solid, be finely divided to pass through the print screen, that is, the paste should be micro-pulverized and have a particle diameter smaller than the opening in the screen. The paste must not only pass through the screen, but it must do so freely so that it will be dispersed uniformly throughout the pile fabric to be treated and effect a uniform reduction in fiber length.

As previously noted, the etching agent is one which is dormant during the successive printing operations but is then activated by the elevated temperature of the steamer or steam chamber which is the same or an identical chamber to that used to fix the dye onto the fibers of the pile.

Thickening agents for use in the practise of the invention must be capable of forming an aqueous dispersion having the consistency of paste and be substantially non-reactive with the etching agents hereinabove described under the conditions of use recited herein. Particularly preferred are modified xanthan, the thickeners designated by the trade name Kelzan (manufactured by Kelco Co.) and that referred to as XB-23 manufactured by General Mills Chemicals, Inc.

The viscosity of the pastes utilized in accordance with the invention will vary within the range of about 3,000 centipoises (cps) to about 60,000 cps and may be varied somewhat above and below these limits depending upon the depth of penetration of the paste into the pile height of the fabric that is desired and the parameters of time, temperature and steam concentration applied within the steamer, the particular etching acids employed, the sequence of etching and printing steps and the particular nylon fabric being treated. The foregoing range has however been found most effective to achieve the desired depth of penetration and reduction in pile height.

Since the process of the invention achieves a sharp definition between treated and untreated areas of the fabric, for most purposes an etching depth of from about 15 percent to 50 percent of the pile height yields a desirable and satisfactory embossing contrast, although a reduction in pile height sufficient to give the desired visual effect is all that is needed. If desired however, ninety percent, or indeed, the entire pile in the treated areas of the fabric can be removed by the practise herein described. The effective depth of penetration can be enhanced by lengthening the residence time of the etching paste in the steamer; but the more reduced this period is the more economically efficacious the process.

Accordingly, it has been found that a steamer dwell time of 4 to 40 minutes is practicable although shorter or longer periods are operative in combination with effective control of the other parameters described herein. In terms of the length of the usual steamer through which pile fabric is passed the usual residence time within the steaming chamber is about six to thirty minutes and preferably about ten minutes.

The effect of using low or high live steam concentration in the steamer on steaming time, that is, the period of time within which a pile fabric to which etching paste has been applied is steam treated, remains constant, regardless of the steaming temperature. Live steam concentration is a function of the rate of steam flow to and escape from the steamer; we believe this is the one of the more controlling factors in the etching process. The effect of steam concentration on steaming time remains constant regardless of steaming temperatures. Thus steaming time may be reduced as much as 45% by insuring maximum steam concentration in the steam. In general steaming temperature within the range of 195° F. (91° C.) to 225° F. (107° C.) have been found to be suitable. An increase in temperature has been found to rapidly reduce the steaming time required for complete etching at low steaming temperatures. This effect is nonlinear and has little or no effect at steaming temperature above 220° F. However, at the higher steaming temperatures the concentration of live steam in the steamer chamber still provides a practicable way for controlling steaming time even though the effect of temperature has been substantially eliminated as a meaningful consideration in this regard.

It is to be understood that in achieving chemical etching according to this invention multiple level etching can also be obtained by applying pastes to different areas wherein the penetration of the pastes are different to allow for multiple levels of etching.

Substantial variations and flexibility exist in the manner in which the etching acid is applied. When printing as well as etching of the fabric is to be effected; and since pile fabric whether used for carpet or other purposes is often printed and it is considered esthetically attractive to emboss pile fabric in register with a particular print, the interrelationships of printing and etching according to the invention are particularly significant.

One method of obtaining specific color in the etched area can be accomplished by using a conventional screen printing apparatus. A standard non-etching printing paste containing a suitable nylon dye is first applied to the surface of a nylon pile fabric after which a clear non-dye containing etching paste is applied through a screen of the same design to provide for etching of the previously printed pile yarn. It is understood that in the printing step, using this particular sequence, the penetration of the dye must exceed the depth of etching secured in the second phase of the treatment in order that a portion of the dye applied to the fibers be retained in the etched product. Sufficient etching paste must be applied to compensate for the dilution effect of the non-etching print paste present.

Variations of these method are feasible, as by way of illustration, where a dye component is incorporated in the etching paste rather than the application of the etching agent in a separate step, as described above.

The concentration of etching acid as noted hereinabove is one which provides a hydrogen ion concentration lower than a pH of 1. Consistent with the theory of activity alluded to above at this pH and under the steaming conditions and other parameters according to this invention, the etching acids and acid salts characterized herein may hydrolyze the polyamide of the pile fiber into its component acids and amines.

The concentration of etching acid or acid salt in the pile will, in any event, regardless of the operative principle which may be employed vary materially with the specific acid or acids employed. The selection of acid, the appropriate concentration thereof, the amount of pastes applied, in addition to the steaming conditions, are the factors most relevant in arriving at effective selective fiber destruction according to the invention.

By way of further defining these parameters of acid selection and concentration, it has been found, for example, that an etching paste, having a desirable viscosity of about 2,000 cps to 60,000 cps and containing sulfuric acid in a weight concentration of about 29 percent 35 percent, and preferably about 33 percent to 35 percent, provides an effective etching composition. Similarly, an etching paste containing a concentration of about 12 percent to 16.5 percent, and preferably about 15 percent to 16.5 percent, hydrochloric acid has also been found very effective. A minimum concentration of 52 percent and as high as 62 percent phosphoric acid by weight in a paste vehicle has also been found operative for use herein.

Combinations and varying concentrations of acids and salts have also been found to have significant utility, as for example, one formed of about 45 percent phosphoric acid and 5 to 6 percent sulfuric acid and or a combination of 20 weight percent sulfuric acid and 10 weight percent of p-toluene sulfonic acid. Higher concentrations than the minimums and maximums recited are appropriate where etching is effected on a previously wetted and printed pile.

Etching pastes containing about 33 percent sulfuric acid have been found particularly effective in the practise of the invention and have been found to permit greater flexibility in the application of the other parameters herein described while avoiding, by way of illustration, any evidence of spotting, that is, imperfect or partial etching, of portions of the treated surface. However, combinations of sulfuric acid and phosphoric acid have also been determined to give a favorable etching effect. Such combinations are used normally in concentrations by weight of the total etching composition of about 4 percent to 6.5 percent, and preferably about 6 percent $H_2SO_4$ to about 55 percent to 45 percent phosphoric acid respectively. The phosphoric acid may be replaced in whole or in part by an alkali metal bisulfate, for example, sodium bisulfate (sodium acid sulfate).

Where etching is effected on wet nylon pile, the maximum concentrations of etching acid can be increased about five percent in each instance. Thus, the maximum hydrochloric acid concentrations for "etching-on-wet" application can be about 20 percent to 25 percent by weight of the paste composition; maximum sulfuric acid concentrations can be about 39 percent.

The reference to minimum concentrations of a particular etching acid means the lowest amount of an acid necessary to induce etching sufficient for complete removal of the etched pile from the carpet by sequential washing of the treated carpet and brushing of it thereafter when dried. The rate of pile destruction is directly proportionate to acid concentration. At excessively high acid concentrations, that is, about the maximum provided, the nylon pile is decomposed into a gel—like mass almost instantaneously as the pile fiber comes into contact with the etching paste. The gelled nylon, in this instance, plugs up the printing screen and makes the etching process inoperative. Thus, a term of reference in determining maximum concentration of etching acid is the greatest amount of etching acid that can be present in any nylon amount of etching paste which when applied to nylon pile through a print screen will not cause any plugging of the screen by gelled nylon.

The minimum etching concentrations are particularly significant in that partially etched pile cannot be removed from the etched carpet. Depending on the degree of etching, short of completion, either the entire etched area may be covered by the fused pile, or if, for example, the steaming phase is interrupted short of completion scattered fused tips of pile will remain on the etched area even after washing and brushing.

The etching paste is applied through a print screen bearing the desired pattern in the same manner as that in which a printing paste is applied. The paste is deposited upon and passed through the screen by conventional means, that is, rollers made of steel or neoprene, or sponge covered rolls are used to force the paste through the screen. The sponge covered rolls increase the depth of the penetration of the paste. The sequence of operations after application of the paste is then: (1) steaming to develop the etching or fiber destruction; (2) termination of steaming; (3) washing to bring pH to approximately 6: (4) drying and then (5) brushing.

Brushing to the etched fabric after washing and drying can be accomplished using substantially rigid brushes mounted about a roller over the fabric which passes normally although not necessarily beneath the brushes. Illustrative brush nylon filaments are about 1.25 inches to 1.5 inches in length and the filaments about 23 to 28 mils (mil=0.001 inch) in thickness. Two brushes rotating in opposite directions have been found most desirable for complete removal of etched yarn. Illustrative brush speeds are about 1,000 to 3,500 feet per minute, complemented by a carpet or other pile fabric speed of 10 to 40 feet per minute. The purpose of brushing, is of course to dislodge the destroyed fibers.

A critical step of the novel process of this invention involves terminating the embossing or etching action and effecting substantial removal of the etching agent from the pile fabric. It may be necessary to achieve complete elimination of all residues of embossing process which may contribute undesirable properties to the finished fabric, such as odor, toxicity and color and texture change. Needless to say, any termination or quenching technique resorted to will depend on the particular embossing composition employed. The most useful technique for removing residues of the embossing process is by thoroughly washing the fabric with water and detergents. In those instances where the etching agent is part of a dye or pigment composition, the washing cycle which is utilized to remove excess dye or pigment serves also to remove traces of the agent. Neutralization of the acid can be accomplished more rapidly if the aqueous solution used for washing includes a mild alkali, for example ammonia.

Components of the novel agents and compositions employed in accordance with the invention can be converted into essentially non-toxic, odorless and otherwise objectionable compounds in the waters used in the washing of the fabric.

The invention has particular application to tufted carpets which are to have a printed decoration applied thereon. Unusual design effects can also be obtained when the pile fabric is printed with a multi-colored design wherein one or more of the dye compositions contain the appropriate etching agent. The process of printing such carpets includes the steps of passing carpets, tufted of unpigmented or colored fibers, into a screen printing apparatus whereby a design is printed on the surface of the carpet. Each screen applies a separate color to make up the final design. The etching agent can be added to one or more of these printing stations by addition to the composition, or it can be applied by a separate station in a transparent vehicle. The fabric is then passed into the steaming chamber to set the dyes and cause etching and then to a washing cycle which serves to remove excess dye as well as to terminate the etching action, to remove the etching components, and to remove the destroyed fiber.

Accordingly, in the etching of carpet or other textured pile fabric, such as drapery materials or wall covering, it is important that, when desired, any color design on the surface of the carpet which is related to the etching be in accurate register or distribution with the etching. Since the concern, in accordance with the invention, is only with chemical etching. the problem is then one of inducing differential pile height between the etched areas and the unetched areas by selective predetermined fiber destruction with sharp definition and no significant deterioration of what is left—objectives secured according to the practise herein described.

A simple test to evaluate the effectiveness of a particular chemical or combination of chemicals as etching agents for particular pile fabrics is described below. The etching agent is incorporated at several concentrations in printing pastes and applied to a section of nylon carpet by means of a screen printing technique to a substantial depth so as to simulate plant production procedure as closely as possible. The treated carpet sample is steamed for 15 minutes at 215°-230° F. (102°-110° C.), thoroughly rinsed with water, dried at 180° F. and brushed to remove the etched fibers. The depth of the etching is then measured and observations made regarding the character of the nylon left in the etched areas e.g. strength, brittleness, softness, definition, color. Measurement of the pile height at the etched and unetched areas is made by means of a thin, steel ruler marked off in 1/64 inch (0.4 millimeter) intervals. Any method of measurement is useful so long as it is standardized from operation to operation and is reproducible to about 1/64 inch.

The following examples are further illustrative of the invention. In these examples all parts and percentages are by weight unless otherwise expressly indicated.

EXAMPLE I

This example illustrates the etching of nylon carpet fabric at different rates of speed and depths of penetration and using different etching acids and where, in addition, the fabric has been printed prior to etching ("etching-on-wet").

(a) A colorless paste containing 35% sulfuric acid (18,000 cps viscosity) was applied by conventional screen printing technique over the freshly printed area of the carpet fabric (through a duplicate screen of that used for the printing). The sample was steamed for 15 minutes at 215° F., then washed and wrung four times with water, and dryed. After drying the upper part of the pile, equal to the depth of the penetration of the etching paste was brittle. This part of the pile was easily removed from the carpet by brushing with a medium-hard brush. The end effect was a carpet sample decorated by a two level pile height. An application in which the acid was applied by four passes of a double steel roller squeegee over the print screen it reduced the pile height by 47%. Pile height of another sample was reduced by 23% of its original height by a two stroke application of the above paste.

(b) Another paste containing 15% $H_2SO_4$ and 20% p-toluene sulfonic acid was printed over plush 14/32 inch pile height carpet by a four stroke application with a two steel roll applicator. Part of the carpet sample, to which the above sulfuric acid p-toluene sulfonic acid paste was applied, was first printed by regular printing paste. The other part of the carpet was dry. After steaming, washing, drying, and brushing off the brittle part of the pile, the pile height of the previously printed part of the carpet sample was reduced by 27%. Pile height of the dry part of the carpet sample was reduced by 37% of its original height.

Edges between high and low levels of the pile in all samples etched by the pastes containing strong acids were sharply defined. The yarn in the etched areas was as soft as the rest of the sample.

EXAMPLE II

The following example illustrates the use of a different etching acid and the relative effect of neoprene sponge covered applicator rolls and steel applicator rolls.

(a) A paste containing 16.5% HCl (Kelzan thickener) at 6300 cps was screen printed over portions of a two ply twised yarn ½ inch pile height carpet sample. Both rolls of the applicator were wrapped with ⅛ inch thick neoprene sponge. Pile heights of samples were reduced by 60% and 40% of the original height by two and one stroke applications, respectively. A three stroke application removed 90–100% of the pile.

(b) A three stroke application by a two steel roll application (no sponge on the rolls) of 15% HCl containing paste (18,000 cps.) on dry 20 ounce per square yard, ⅛ inch pile height level loop type fabric, produced almost complete removal of the pile. A two stroke application shortened the pile height by 57%, and a one stroke application reduced the pile height of the same carpet fabric by 35%.

EXAMPLE III

This example illustrates further etching compositions and their effect on a nylon pile carpet.

Samples of nylon two ply cut pile, ½ inch pile height carpet were etched dry by several etching paste containing $H_2SO_4$ acid. Etching pastes were applied by four strokes of a steel double roll applicator. After various steaming times at 218° F. steamer temperature, the etched samples were, washed, wrung, dried and brushed in a manner similar to that described in Examples I and II above. Etching conditions and results are tabulated in Table I.

TABLE I

| Paste | Paste Viscosity (CPS) | Steaming Time (Min.) | Etching Depth (Percent) | Etched Pile After Washing | Appearance of Dry Etched Pile |
|---|---|---|---|---|---|
| a) 33% $H_2SO_4$ | 8,800 | 6 | 60 | all removed | soft |
| b) 33% $H_2SO_4$ | 8,800 | 9 | 70–80 | all removed | soft |
| c) 45% $H_3PO_4$/6% $H_2SO_4$ | 12,000 | 30 | 50–60 | all removed | soft |
| d) 55% $NaHSO_4 . H_2O$/ 10% $H_2SO_4$ | 10,400 | 30 | 50 | all removed | soft |

EXAMPLE IV—PRODUCTION OPERATION

This example illustrates a plant trial of the etching process according to the invention. Etching paste was applied to dry previously dyed nylon carpet pile.

Cut pile, two ply twisted yarn ½ inch pile height carpet fabric having a width of 12 feet was etched with a paste containing 33% sulfuric acid having a viscosity of 8,500 cps. The thickener used was XB-23 manufactured by General Mills Chemicals, Inc. The etching paste was deposited uniformly upon the fabric through a flat screen by a four stroke application with steel rolls. Average temperatures and variations thereof employed in the steaming chamber to effect etching were as indicated in Table II.

TABLE II

| Paste | Steamer Front Temperature (F.) Average | Steamer Front Temperature (F.) Variation | Steamer Middle Temperature (F.) Average | Steamer Middle Temperature (F.) Variation | Steamer Recorder Temperature (F.) Average | Steamer Recorder Temperature (F.) Variation | Sparger Steam Pressure (PSI) | Steaming Time Minutes |
|---|---|---|---|---|---|---|---|---|
| 33% H2SO4 | 219 | 214<br>222 | 223 | 222<br>226 | 232 | 230<br>234 | 31 constant | 20 |

Most of the etched yarn was removed from the fabric during washing and the remaining etched portions became brittle upon drying. These etched fiber ends were removed by using brushes with medium hard filaments and medium spaced brush tufts. The etching depth was 50–65% of the original pile height.

Based on information collected in this trial, the "etch on dry" is a feasible process for making bi-level nylon carpet constructions. Standard printing rates (four stroke) and standard steaming times used in regular production can be used in the "etch on dry" process. It is advisable to have the steamer temperature at 220° F. or higher. The back pressure on the sparger line should be maintained at 25 psi or higher.

At line speed of 8 ft./minute and steaming conditions illustrated the etching process was completed.

EXAMPLE V—LABORATORY EXPERIMENTS

The following tables summarize the conditions used (in) and the data obtained from experiments run in the laboratory.

Table III, IV, and V present the "etch on dry" process. Table III deals with single inorganic acid. Table IV deals with mixed acids. Table V deals with acid/-nonacid mixtures. Table VI presents the "etch on wet" process in which two pastes are used. The first paste (print paste) contains both dye and some acid; the second (etch paste) contains sufficient acid to cause etching to occur in the "wet" previously printed nylon carpet fabric.

In all these runs a 28 ounce per square yarn plush, 16/32 inch pile height nylon carpet fabric was used with the exception of the 15.5% HCL run of Table III in which a 20 ounce/square yard loop, 7/32 inch pile height nylon carpet fabric was used. Also in the five samples etched by sulfuric acid in Table III a 44 ounce/-square yard two ply 16/32 inch pile height Saxony nylon carpet fabric was used in addition to the plush.

All samples after steaming were water washed, passed through a wringer four times and dried at 160°–180° F.

TABLE III

Dry pile of nylon carpet was etched with pastes prepared according to the following formulas:

| (Laboratory no.) Components | 4328-33 14% HCl Paste | 9,10,11 15.5% HCl Paste | 61,63 27% H2SO4 Paste | 62,64 29% H2SO4 Paste | 58,55 31% H2SO4 Paste | 56,59 33% H2SO4 Paste | 57,60 35% H2SO4 Paste |
|---|---|---|---|---|---|---|---|
| Water | 180 | 129 | 519 | 499 | 479 | 459 | 439 |
| Thickener (5% Kelzan) | 180 | 140 | 205 | 205 | 205 | 205 | 205 |
| Surfactant (Ciba Phasol AS) | 6 | 2 | 6 | 6 | 6 | 6 | 6 |
| HCl (36%) | 234 | 207 | — | — | — | — | — |
| H2SO4 | — | — | 270 | 290 | 310 | 330 | 350 |
| Viscosity (Brookfield #3 spindle 2.5RPM | 25,000 cps. | 18,000 | 6,700 | 7,600 | 8,600 | 9,600 | Very Low |
| Application | 3 strokes steel doub. rolls. | Steel doub. rolls a. 2 stroke b. 1 stroke c. 1 stroke paste in front roll | 4 strokes - steel double roll applicator | | | | |
| Steaming | 15 min @218-220 | 15 min @220 | 15 minutes | @218F. | | | |
| Etching | 40-50% | a. 90-100% b. 57% c. 25% | Yarn weak but hard to remove by brushing | pl.-50% sax.-50-60% | pl.-90-100% sax.-50-60% | pl.-90-100% sax.-50-60% | pl.90-100% sax.50-100% |

Dry pile of nylon carpet was etched with pastes prepared according to the following formulas:

| (Laboratory run no.) Components | 73 50% H3PO4 Paste | 33 52% H3PO4 Paste | 33 54% H3PO4 Paste | 318 60% H3PO4 Paste | 319 66% H3PO4 Paste |
|---|---|---|---|---|---|
| Water | 98 | 16 | 11 | 29.5 | — |
| Thickener (5% Kelzan) | 105 | 60 | 60 | 86.0 | 86 |
| Surfactant (Ciba Phasol AS) | 3 | 2 | 2 | 2.0 | 2 |
| H3PO4 (85%) | 294 | 122 | 127 | 282.5 | 312 |
| Viscosity (cps.) (Brookfield #3 spindle 2.5 RPM) | 24,000 | 16,400 | 17,600 | 15,200 | 5,000 |
| Application | 4 strokes - steel double roll applicator | | | | |
| Steaming | All samples were steamed 20 minutes at 220 F. | | | | |
| Etching | No useful etch | 25-35% | 50% | 60% | 100% (screen plugged by gelled yarn) |

TABLE IV

Dry pile of nylon carpet was etched with pastes prepared according to the following formula:

| (Laboratory Run No.) Components | 77 45% H3PO4 + 4% H2SO4 Paste | 78 45% H3PO4 + 6% H2SO4 Paste | 79 45% H3PO4 + 8% H2SO4 Paste | 80 45% H3PO4 + 10% H2SO4 Paste |
|---|---|---|---|---|
| Water | 107 | 97 | 87 | 77 |
| Thickener (5% Kelzan) | 105 | 105 | 105 | 105 |
| Surfactant (Ciba Phasol AS) | 3 | 3 | 3 | 3 |
| H3PO4 (85%) | 265 | 265 | 265 | 265 |
| H2SO4 | 20 | 30 | 40 | 50 |
| Viscosity - cps (Brookfield #3 spindle 2.5RPM) | 23,000 cps. | 24,800 cps. | 24,000 cps. | Very Low |
| Application | 4 strokes - steel double roll applicator | | | |
| Steaming | All Samples were steamed 20 minutes @220F | | | |
| Etching | No Useful etch | 30% | 40% | 100% |

Dry pile of nylon carpet was etched with pastes prepared according to the following formulas:

| (Laboratory Run No.) Component | 74 50% H3PO4 + 2% H2SO4 Paste | 75 50% H3PO4 + 4% H2SO4 Paste | 76 50% H3PO4 + 6% H2SO4 Paste |
|---|---|---|---|
| Water | 88 | 78 | 68 |
| Thickener (Kelzan 5%) | 105 | 105 | 105 |
| Surfactant (Ciba Phasol AS) | 3 | 3 | 3 |
| H3PO4 (85%) | 294 | 294 | 294 |
| H2SO4 | 10 | 20 | 30 |
| Viscosity (Brookfield #3 spindle 2.5RPM) | 23,600 cps. | 25,200 cps. | 12,000 cps. |
| Application | 4 strokes - steel double roll applicator | | |

TABLE IV-continued

| | | | | |
|---|---|---|---|---|
| Steaming | 20 Minutes @220 F. | | | |
| Etching | No useful etch | 43% | 65% | |

Dry pile of nylon carpet was etched with pastes prepared according to the following formulas:

| (Laboratory Run No.) | 1 | 121 | 316 | 317 |
|---|---|---|---|---|
| Components | 7.5% H2SO4 + 55% NaHSO4 paste | 6% H2SO4 + 60% Acetic Acid Paste | 35% Toluene Sulfonic Acid Paste | 46% Methane Sulfonic Acid Paste |
| Water | 70.5 | 95 | 69 | — |
| Thickener (Kelzan 5%) | 59.0 | 70 | — | — |
| Thickener (3% XB-23) | — | — | 60 | 67.5 |
| Surfactant (Ciba Phasol AS) | 2.0 | 3 | 1 | 1.0 |
| H2SO4 (95%) | 26.5 | 31.5 | — | — |
| Na HSO4 | 193.0 | — | — | — |
| Acetic Acid (Glacial) | — | 300 | — | — |
| p-toluene sulfonic acid | — | — | 70 | — |
| Methane sulfonic acid | — | — | — | 131.5 |
| Viscosity (Brookfield #3 spindle, 2.5RPM) | 2,000 cps. | 4,000 cps. | 1,400 cps. | 17,600 cps. |
| Application | 6 str.-steel doub. roll applicator | 4 str. steel doub. roll applicator | 4 str.-steel doub. roll applicator | 4 str.-steel doub. roll applicator |
| Steaming | 15 min. @215–218 F. | 20 min. 220 F. | 20 min. @220 F. | 20 min. @220 F. |
| Etching | 75% | 80–90% | 40% | 70% |

TABLE V

| (Lab Run No.) | 322 | 260 | 267 | 327 | 328 | 325 | 271 | 324 | 320 |
|---|---|---|---|---|---|---|---|---|---|
| Components | 25% H2SO4 + 20% Dichloro Methane Paste | 25% H2SO4 + 20% 1, 2 Dichloro Ethane Paste | 20% H2SO4 + 25% Dioxane Paste | 25% H2SO4 + 20% 2-Butanone Paste | 25% H2SO4 + 20% Methyl Isobutyl Ketone Paste | 20% H2SO4 + 25% Cellosolve Acetate Paste | 20% H2SO4 + 25% Methyl Cellosolve Acetate Paste | 20% H2SO4 + 20% Butyl Cellosolve Acetate Paste | 25% H2SO4 + 20% Butyl Carbitol Paste |
| Water | 89 | 72 | 72 | 89 | 89 | 92 | 72 | 92 | 89 |
| Thickener (Kelzan 5%) | 59 | — | — | 70 | 70 | 70 | — | 70 | 70 |
| Thickener (3% XB-23) | — | 90 | 90 | — | — | — | 90 | — | — |
| Surfactant (Ciba Phasol AS) | 2 | 2 | 3 | 2 | 2 | 2 | 3 | 2 | 2 |
| H2SO4 (95%) | 79 | 78 | 63 | 79 | 79 | 63 | 63 | 63 | 79 |
| Dichloro Methane | 60 | — | — | — | — | — | — | — | — |
| 1-2 Dichloro Ethane | — | 60 | — | — | — | — | — | — | — |
| Dioxane | — | — | 75 | — | — | — | — | — | — |
| 2-Butanone | — | — | — | 60 | — | — | — | — | — |

| (Lab Run No.) | 322 | 260 | 267 | 327 | 328 | 325 | 271 | 324 | 320 |
|---|---|---|---|---|---|---|---|---|---|
| Components | 25% H2SO4 + 20% Dichloro Methane Paste | 25% H2SO4 + 20% 1, 2 Dichloro Ethane Paste | 20% H2SO4 + 25% Dioxane Paste | 25% H2SO4 + 20% 2-Butanone Paste | 25% H2SO4 + 20% Methyl Isobutyl Ketone Paste | 20% H2SO4 + 25% Cellosolve Acetate Paste | 25% H2SO4 + 25% Methyl Cellosolve Acetate Paste | H2SO4 + 20% Butyl Cellosolve Acetate Paste | 25% H2SO4 + 20% Butyl Carbitol Paste |
| Methyl Isobutyl Ketone | — | — | — | — | 60 | — | — | — | — |
| Cellosolve Acetate | — | — | — | — | — | 75 | — | — | — |
| Methyl Cellosolve Acetate | — | — | — | — | — | — | 75 | — | — |
| Butyl Cellolsve | — | — | — | — | — | — | — | 75 | — |
| Butyl Carbitol | — | — | — | — | — | — | — | — | 60 |
| Viscosity (cps) (Brookfield #3 spindle 25 RPM) | 12,000 | 16,000 | 13,000 | 8,000 | 12,000 | 6,800 | 14,000 | 11,200 | 9,200 |
| Application | 4 strs-steel double rolls | 6 strs.- steel double rolls | | 4 strs- steel double rolls | | | | | |
| Etching | 50–60% | 100% | 60–70% | 50–60% | 30% | 40–50% | 40–50% | 50–60% | 50–60% |

TABLE VI

Wet printed nylon carpet was etched with pastes prepared according to the following formulas:

| (Laboratory Run No.) | 246,247,248,249 | 241 | 314, 315 |
|---|---|---|---|
| | Printing Paste - 12% H2SO4 | Printing Paste - 12% | Printing Paste - 12% |

TABLE VI-continued

| Components | Etching Paste - 45% H3PO4 + 6% H2SO4 | | H2S04 Etching Paste - 45% H3PO4 + 6% H2SO4 | | H3P04 Etching Paste 33% H2SO4 | |
|---|---|---|---|---|---|---|
| | Print Paste | Etch Paste | Print Paste | Etch Paste | Print Paste | Etch Paste |
| Water | 1122 | 285 | 364 | 190 | 1560 | 1056 |
| Thickener (5% Kelzan) | 180 | 210 | 70 | 140 | — | — |
| (3% XB-23) | — | — | — | — | 180 | — |
| Surfactant (Ciba Phasol AS) | 9 | 9 | 3 | 6 | 8 | 8 |
| H3PO4 (75%) | — | 900 | — | 600 | — | — |
| H2SO4 (95%) | 189 | 96 | 63 | 64 | 252 | 696 |
| Dye | 0.5 | — | 0.5 | — | 0.5 | — |
| Viscosity (Brookfield #3 spindle 2.5 RPM) | 1,000 cps. | 7,500 cps | 2,200 cps. | 11,600 cps | 2,000 cps | 1,500 cps |
| Application | 1,2,4,6 strokes steel doub. roll | 6 strokes - single roll, wrapped in ¼" soft sponge | 8 strokes - steel doub. roll | 10 strokes - steel doub. roll | 4 strokes - steel doub. roll | 4 strokes double roll wrapped in ¼" soft sponge |
| Steaming | 15 minutes @220F | | 15 minutes @223F | | 20 minutes @230 F. | |
| Etching | one stroke print-60–65% etched<br>two strokes print-60–65% etched<br>four strokes print-50% etched<br>six strokes print-35–40% etched | | 25–30% | | 28 oz./yd.$^2$ plush-80–100%<br>44 oz./yd.$^2$ Saxony-70–80 | |

Wet printed nylon carpet was etched with pastes prepared according to the following formulas:

| (Laboratory Run No.) | 252* Print 5% H2SO4 Paste* Etch 45% H3PO4 + 6% H2SO4 Paste | | 237 Print 4% H2SO4 Paste Etch 45% H3PO4 + 8% H2SO4 Paste | | 32 Print 67 HCl Paste Etch 16% HCl Paste | |
|---|---|---|---|---|---|---|
| Components | Print Paste | Etch Paste | Print Paste | Etch Paste | Print Paste | Etch Paste |
| Water | 421 | 170 | 400 | 75 | 411 | 98 |
| Thickener (5% Kelzan) | 50 | 160 | 76 | 80 | 85 | 120 |
| Surfacant (Ciba Phasol AS) | 3 | 6 | 3 | 3 | 4 | 4 |
| H3PO4 (75%) | — | 600 | — | 300 | — | — |
| H2SO4 (95%) | 26 | 64 | 21 | 42 | — | — |
| HCl (36%) | — | — | — | — | 100 | 178 |
| Dye | 0.3 | — | 0.3 | — | 0.3 | — |
| Viscosity (Brookfield #3 spindle 2.5 RPM) | 900 cps | 1,200 cps | 3,600 cps | 8,200 cps | 1,200 cps | 18,000 cps |
| Application | 1 stroke steel double rolls | 6 strokes single roll wrapped in ⅛" soft sponge | 6 strokes steel double rolls | 10 strokes steel double rolls | 8 strokes steel double rolls | 4 strokes double rolls wrapped wrapped with ⅛" soft sponge |
| Steaming | 15 mins. @223 F. | | 15 mins. @223 F. | | 15 minutes @218–220 F. | |
| Etching | 35–50% | | 40% | | 40–50% | |

Wet printed nylon carpet was etched with pastes prepared according to the following formulas:

| (Laboratory Run No.) | 41,43 Printing Paste - 40% H3PO4 Etching Pastes - 54% and 58% H3PO4 | | | 234 Printing Paste - 15% H3PO4 Etching Paste - 45% H3PO4 + 8% H2SO4 | |
|---|---|---|---|---|---|
| Components | Print Paste | 54% H3PO4 Etch Paste | 58% H3PO4 | Print Paste | Etch Paste |
| Water | 533 | 47 | 38 | 357 | 150 |
| Thickener (5% Kelzan) | 96 | 25 | 25 | 40 | 160 |
| Surfactant (Ciba Phasol AS) | 6 | 1 | 1 | 3 | 6 |
| H3PO4 (85%) | 565 | 127 | 136 | — | — |
| H2PO4 (75%) | — | — | — | 100 | 600 |
| H2SO4 (95%) | — | — | — | — | 84 |
| Dye | 1.0 | — | — | 0.3 | — |
| Viscosity (Brookfield #3 spindle 2.5 RPM) | 900 cps. | 10,000 cps. | 12,400 cps. | 1,000 cps. | 10,800 cps |
| Application | 8 strokes steel double rolls | 4 strokes - double rolls wrapped with ⅛" soft sponges | | 6 strokes - steel double rolls | 8 strokes steel double rolls |
| Steaming | 15 minutes @218–220F. | | | 15 minutes @233 F. | |
| Etching | | 40–50% | 60–80% | | 40% |

*A 36 oz./sq. yd.; two ply, 16/32 inch pile height Saxony nylon carpet fabric.

It will be evident that the terms and expressions which have been employed are used as terms of description and not of limitation. There is no intention in the use of such terms and expressions of excluding equivalents of the features shown and described or portions thereof and it is recognized that various modifications are possible within the scope of the invention claimed.

What is claimed is:

1. A process for producing an etched effect on nylon pile fabric having a wearing surface of nylon fibers that comprises applying to said nylon fibers in defined areas of the surface of said pile a chemical etching agent for said fibers blended with a thickening agent to form a paste wherein said etching agent is present in a concentration sufficient to effect destruction of the portions of said fibers contacted with said paste and wherein said etching agent comprises one or more acids or acid salts having a dissociation constant stronger than acetic acid, and providing said resulting paste with a hydrogen ion concentration equivalent to a pH no higher than 1, contacting said portions of said fibers remote from the base of said fabric to which said fibers are secured with said paste, and maintaining said paste in contact therewith, in an atmosphere of steam, for a period of time sufficient to destroy that portion of each of said fibers of said pile contacted by said paste to a predetermined depth remote from said base to render that part of the fibers mechanically removable.

2. The process of claim 1 wherein said paste is applied to printed wet pile.

3. The process of claim 1 wherein said atmosphere of steam is superheated and is maintained at a temperature within the range of 180° F. and 250° F.

4. The process of claim 1 wherein said etched effect is made in register with a printed color design on said fiber and said paste is clear.

5. The process of claim 1 wherein said paste is a color print paste.

6. The process of claim 1 wherein said paste has a viscosity of from about 3000 cps to 60,000 cps.

7. The process of claim 6 wherein said paste is maintained in contact with said fibers for a period of 4 to 30 minutes.

8. The process of claim 1 wherein said etched sculptured effect is achieved at multiple levels by application of a plurality of pastes containing a different etching agent or the same or different etching agents in different concentrations, or the same or different thickening agents in different concentrations.

9. The process of claim 1 wherein said paste and the etched portions of said fibers are contacted with an aqueous medium.

10. The process of claim 1 wherein said aqueous medium is alkaline.

11. The process of claim 1 wherein said paste contains as its etching agent, sulfuric acid, hydrochloric acid, phophoric acid, mixtures thereof, or a mixture of one or all of the foregoing with p-toluene sulfonic acid or with sodium acid sulfate.

12. The process of claim 1 wherein said etching agent is sulfuric acid.

13. The process of claim 12 wherein said sulfuric acid is present in said paste in a concentration of about 29 percent to about 35 percent by weight.

14. The process of claim 11 wherein said etching agent is a mixture of sulfuric acid and phosphoric acid.

15. The process of claim 11 wherein said etching agent is hydrochloric acid.

16. The process of claim 11 wherein said etching agent is a mixture of sulfuric acid and p-toluene sulfonic acid.

17. The process of claim 11 wherein said etching agent is a mixture of sodium acid sulfate and sulfuric acid.

18. A process as claimed in claim 1 for producing an etched effect on nylon pile fabric wherein the portions of each of said fibers of said pile destroyed by said paste are mechanically removed to provide an etched sculptured effect in the areas of said pile treated with said paste.

19. A process as claimed in claim 11 wherein said etching agent is phosphoric acid.

* * * * *